US005543698A

United States Patent [19]

Tao et al.

[11] Patent Number: 5,543,698

[45] Date of Patent: Aug. 6, 1996

[54] METHOD AND APPARATUS USED WITH AC MOTOR FOR DETECTING UNBALANCE

[75] Inventors: Jinghan Tao, Shorewood; John Merrison, Wauwatosa, both of Wis.

[73] Assignee: Allen-Bradley Company, Inc., Milwaukee, Wis.

[21] Appl. No.: 313,487

[22] Filed: Sep. 27, 1994

[51] Int. Cl.[6] ..... G05B 5/01

[52] U.S. Cl. ..... 318/611; 73/462

[58] Field of Search ..... 318/611, 623, 318/632, 685, 696; 73/862.08, 862.28, 862.29, 862.372, 862.326, 460, 462, 862.041, 862.13, 862.193, 862.191; 361/23, 24, 88; 323/267, 208, 211; 68/12.01, 12.06

[56] References Cited

U.S. PATENT DOCUMENTS 3,403,538 10/1968 Andrew et al. ..... 68/12.06
3,859,564 1/1975 Zulaski ..... 361/88
4,513,464 4/1985 Rettich et al. ..... 68/12.06
5,281,956 1/1994 Bashark ..... 340/660
5,325,677 7/1994 Payne et al. ..... 68/12.01
5,384,696 1/1995 Moran et al. ..... 323/207
5,448,442 9/1995 Farag ..... 361/24

*Primary Examiner*—Jonathan Wysocki
*Attorney, Agent, or Firm*—Michael A. Jaskolski; John M. Miller; John J. Horn

[57] ABSTRACT

A method and apparatus used with a motor controller that detects load imbalance at a relatively low speed and, if the degree of load imbalance is greater than a predetermined acceptable maximum degree, produces an alarm signal that indicates an imbalanced load. If the degree of load imbalance is greater than the predetermined acceptable maximum value, the present invention may either attempt to rebalance the load or stops the motor until the balance can be manually adjusted.

24 Claims, 4 Drawing Sheets

METHOD AND APPARATUS USED WITH AC MOTOR FOR DETECTING UNBALANCE

BACKGROUND

1. Field of the Invention

The present invention relates to three phase AC motors. More particularly, the present invention relates to a method and apparatus to be used with a motor to detect motor unbalance from changes between voltage and current phases at a test frequency. In a preferred embodiment the test frequency is substantially less than an operating frequency.

2. Description of the Art

Many motors are designed to operate with substantially balanced loads where the load is distributed around the axis of rotation in a substantially symmetrical manner. While such motors can safely drive a slightly unbalanced load, if load unbalance is increased beyond a given point the motor itself and the machine housing the motor could easily be damaged.

Often, a load may appear to be substantially balanced and indeed the load may behave as though it is substantially balanced when operating at a relatively low frequency. However, due to uneven increases in centrifugal force as the operating frequency is increased, often a load that appears balanced at a low frequency will be highly unbalanced at a higher operating frequency. As well known, the centrifugal force F on a load can be expressed as:

$$F=m\omega^2 r \quad (1)$$

where m is the mass of the load, $\omega$ is the angular velocity of the motor, and r is the distance from the axis of rotation to the load. When a load is unbalanced, either m1, the mass on one side of a rotational axis, is greater than m2, the mass on the other side or, if m1=m2, r1, the distance of m1 from the axis of rotation, is different than r2, the distance of m2 from the axis of rotation, or both m1 is different than m2 and r1 is different than r2.

Assuming r1=r2 and m1 is greater than m2, referring to Equation 1, as $\omega$ increase, the centrifugal forces on both sides of the rotational axis increase by a factor of $\omega^2$. However, because m1 is greater than m2, F1, the centrifugal force due to m1 will increase more than F2, the centrifugal force due to m2. While the ratio F2/F1 might be identical at high and low velocities, the difference between F1 and F2 will be greater at a higher velocity and therefore, a given unbalanced load will be more damaging at a high velocity than at a low velocity.

In some motors where frequency varies by factors of 100, the effects of even a slight unbalance which appear to be negligible at a low frequency, can be devastating at a higher frequency.

One application where motor unbalance is particularly important is in washing machines. Often clothes or other items are thrown into a washing machine in an unbalanced condition where the clothes tend to pile up on one side or the other of a washing basin. When the load is unbalanced, the washing basin wobbles back and forth at high frequencies until, if not corrected, the machine physically moves or a motor component malfunctions. In addition, if the washing basin wobbles enough, the basin can collide with its frame and damage either itself or the frame.

In order to provide washing machines that can operate safely, the industry has utilized mechanical limit switches. A mechanical limit switch is positioned at the outer boundary of what is thought to be tolerable movement of the washing basin. As the rotational frequency of the washing basin is increased, if the load is balanced, the limit switch is never flipped and full operating frequency is achieved. However, if the load is unbalanced, once the rotational frequency of the washing basin is increased sufficiently, the basin will wobble to the point where the limit switch is flipped and motor operation will normally be suspended until a user can manually balance the load.

While limit switches limit motor and washer component damage, for a number of reasons they are unsatisfactory. For example, limit switches allow a considerable amount of rotor and load wobble before they are activated. While the amount of wobble allowed is insignificant in the short term, over a longer period, the effects of even a small degree of wobble can damage motor components. In addition, as the effects of a given unbalance are greater at higher frequencies of rotation due to centrifugal forces, many times a limit switch will only operate once a high operational frequency is attained at which point the effects of wobble can be severe.

Furthermore, limit switches do nothing to try and rebalance a load once unbalance is detected. Once unbalance is detected, a limit switch simply suspends motor operation until a user attempts to rebalance the load.

In other applications, where motor operation is limited to a relatively low frequency, sustained unbalance and resulting wobble can also adversely effect motor operation and eventually result in expedited motor component deterioration.

Thus, it would be advantageous to have an apparatus and/or method that could determine load unbalance at a relatively low motor speed prior to reaching higher frequencies where motor damage is more likely. It would also be advantageous to have an apparatus that could determine even minimal unbalance where a normal operating frequency is a relatively low frequency. In addition, it would be advantageous to have such an apparatus and/or method that could attempt to automatically balance an unbalanced load without user intervention.

SUMMARY OF THE INVENTION

The present invention determines the degree of load imbalance at a relatively low speed and, if the degree of load imbalance is greater than a predetermined acceptable maximum value, produces an alarm signal that indicates an imbalanced load. In the alternative, if the degree of load imbalance is greater than the predetermined acceptable maximum value, the present invention may either attempt to rebalance the load or stop the motor until the balance can be manually adjusted.

The method of the present invention is to be used with a motor controller for detecting unbalanced load wherein the motor may operate at a number of different frequencies including various operational frequencies, the operational frequencies being relatively high frequencies. The method comprises the steps of: prior to increasing the motor speed to any operational frequency, increasing the motor speed to a test frequency that is substantially less than the operational frequency; maintaining the motor speed substantially equal to the test frequency during a test period; during the test period, determining whether or not the motor load is balanced or unbalanced; if the load is balanced, stepping the motor speed up to the operating frequency; and if the load is unbalanced, producing an alarm signal.

The step of determining whether or not the motor load is balanced or unbalanced may include the steps of continuously determining a phase angle between a stator winding voltage and a stator winding current to produce a phase angle spectrum in the form of a phase angle signal; determining a period of a mechanical cycle of the motor; determining a difference between the maximum and minimum of the phase angle signal during the mechanical cycle to produce a stability signal; comparing the stability signal to an acceptable stability value; and if the stability signal is greater than the acceptable stability value, producing a signal indicating that the load is unbalanced.

Thus, one object of the present invention is to use an extremely sensitive technique to determine load imbalance at relatively low motor speeds. By detecting imbalance at a low speed, the present invention eliminates the possibility of motor damage from driving an unbalanced load at a relatively high speed.

It has been observed that stator winding current magnitude and phase will change when a load is unbalanced. Thus, by observing either current magnitude or phase changes, load unbalance can be detected.

As most motor controllers include bipolar power transistors, IGBT's or other power electronic switching devices, motor current usually contains many high frequency harmonics. Thus, it is relatively difficult to precisely detect changes in current magnitude. However, it is much easier to determine the phase angle between stator winding voltage and current. Because phase angle fluctuation can be identified at a relatively low motor speed, unbalance can be detected at a low speed.

In a preferred method, the step of determining a period of the mechanical cycle includes the steps of generating a first phase signal which is the equivalent of the phase angle signal after light filtering, producing a second phase signal which is the equivalent of the phase angle signal after heavy filtering, and comparing the first and second phase signals to determine the period of a mechanical cycle, the period between each three consecutive crossings of the first and second phase signals being the period of a mechanical cycle.

Also, preferably, the method includes the step of, after the frequency of the motor has reached the test frequency, delaying the step of determining the phase angle for a delay time.

Yet another object is to eliminate sources of error in determining motor imbalance. Often a load will be settling and shifting during the initial stages of a test cycle as the centrifugal forces acting on the load force the load to assume a steady state configuration. If phase angle changes are tracked immediately after the test frequency is reached, any load shifting will produce an alarm signal as such a shift would indicate instantaneous load imbalance. By delaying phase angle tracking for a short period, the load is allowed to settle and steady state imbalance can be detected.

The method may also, if the load appears to be balanced, increase the frequency of the motor to the operating frequency, and if unbalance is detected, stop motor rotation. If the motor is stopped, after a suspension period, the motor may be excited again to rotate at the test frequency and the method of detecting unbalance may again be performed. The method may also include the steps of, if unbalance is detected, driving the motor in a wash cycle where the frequency of rotation is less than the test frequency. During the wash cycle the motor may be rotated in one direction for a short period and then in the other direction for a short period, the rotation direction alternating often during the wash cycle and after the wash cycle, increasing the motor speed again to the test frequency and again detecting the degree of load unbalance.

Thus, it has been recognized that often, when a motor is stopped or driven in a jerking motion, the load may shift and redistribute itself in a more balanced steady state configuration. Once the load is halted or jerked around, the balance can again be determined and the motor driven accordingly. Furthermore, the present invention may include a method for detecting imbalance at a relatively low motor speed where the low speed is actually the operating speed.

The present invention also contemplates an apparatus to be used with a motor controller for detecting unbalanced load. Other and further objects and aspects of the present invention will become apparent during the course of the following description and by reference to the accompanying drawings.

DETAILED DESCRIPTION OF THE PREFERRED EMBODIMENT

Figure 1:
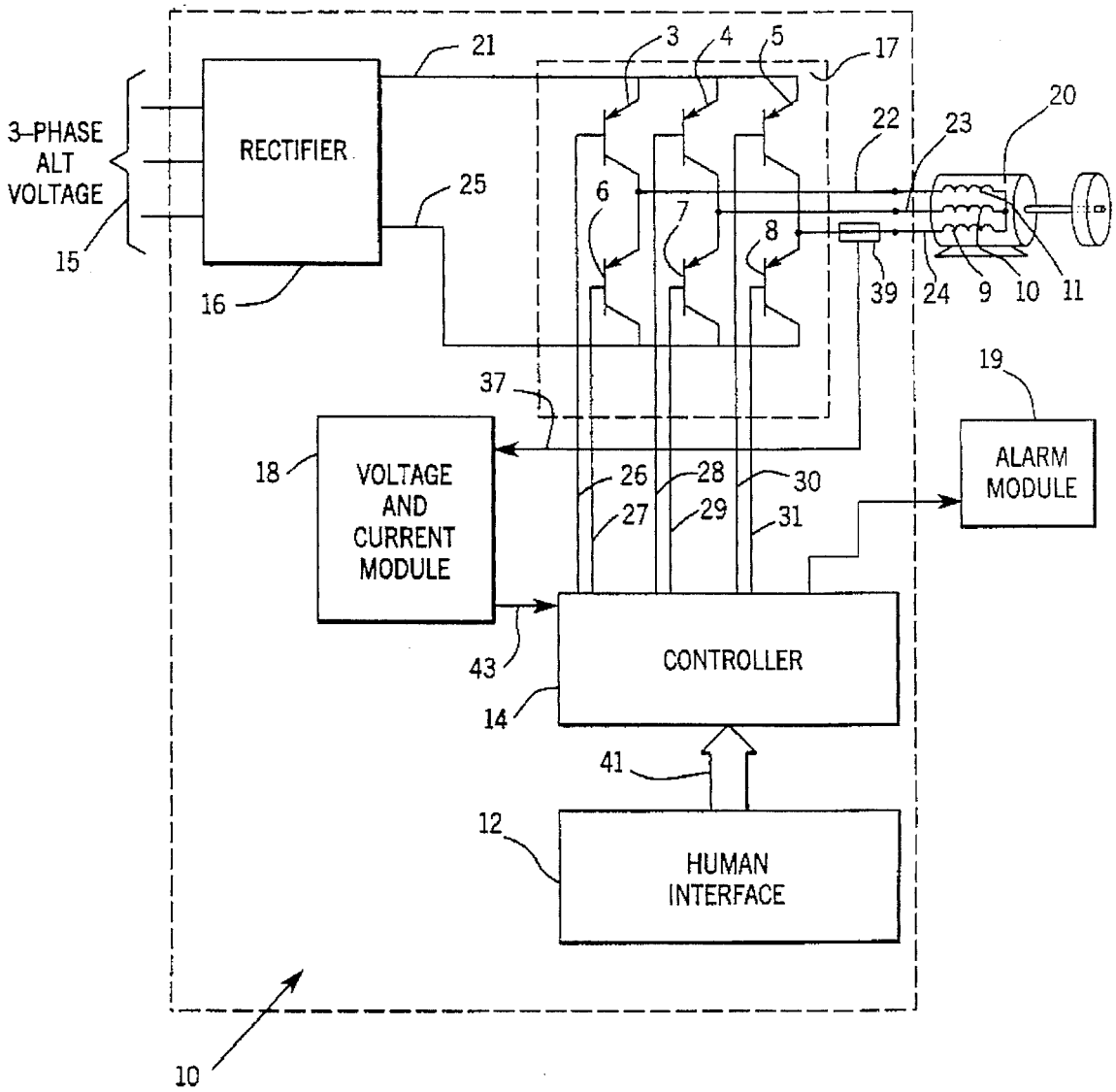
FIG. 1 is a schematic diagram of a motor control system including a controller incorporating the present invention.

The present invention will be described in the context of the exemplary variable frequency motor control system 10 shown in FIG. 1. The control system 10 receives three phase alternating voltage 15, converts the alternating voltage 15 to a direct voltage, converts the direct voltage back to alternating voltage with a chosen frequency in a manner to be described below, and delivers the alternating voltage to a motor 20 along supply lines 22, 23, and 24.

The induction motor 20 has three stator windings 9, 10, and 11 which are usually coupled in a "Y" configuration. The distal end of each stator winding 9, 10, 11 is connected to a separate supply line 22, 23, and 24. The phase of the voltage on supply line 22 leads the phase of the voltage on supply line 23 which in turn leads the phase of the voltage on supply line 24.

The motor control system 10 consists of a rectifier circuit 16, an invertor circuit 17, a controller 14, a human interface 12, a voltage and current detector 18, and an alarm module 19, which are connected and interact as described in detail below.

As well known in the art, the rectifier circuit 16 receives the three phase alternating voltage 15 and produces a direct voltage, providing both positive and negative DC rails 21, 25. The invertor circuit 17, consists of six solid state switching devices 3–8 (a BJT, GTO, IGBT or other transistor technology device may be used) arranged in series connected pairs 3 and 6, 4 and 7, and 5 and 8, each pair connecting the position and negative DC rails 21, 25. A separate supply line 22, 23 or 24 is connected between unique pairs of switches 3 and 6, 4 and 7, or 5 and 8. Each switch 3–8 is controlled by signals provided by the controller 14 on a separate supply line 26–31.

As each pair of series connected switches operates in the same manner as the other pairs, only one pair 5, 8 will be explained. The controller 27 provides firing pulses along control lines 30 and 31 to the switching devices 5 and 8 turning them ON and OFF in an alternating regulated sequence. As the pair of series connected switches 5, 8 alternate between ON and OFF, the supply line 24 which is connected between the switches 5, 8 is alternately connected between the positive and negative DC rails 21, 25. The positive and negative DC voltages thus produce an alternating high frequency series of voltage pulses on line 24.

By varying the firing times of the two switches 5, 8 the widths of the positive portions of each high frequency pulse relative to the negative portions can be varied. By varying the widths of the positive and negative portions of each high frequency pulse over a series of pulses, a sinusoidal alternating average value of pulse voltages can be generated. Referring to FIGS. 1 and 2, the alternating average values define a low frequency alternating voltage 32 across the stator winding 9. The cycle of the alternating voltage 32 is referred to herein as the electrical cycle.

By changing the widths of the positive and negative portions of the high frequency pulses both the amplitude and the frequency of the low frequency alternating voltage 32 can be controlled. As the frequency of the alternating voltage controls the speed of the motor, motor speed can be altered using the controller 14 and inverter 17 described above.

Thus, if the controller 14 can detect load unbalance, when load unbalance is dangerously high, the controller 14 can either suspend motor operation or drive the motor in a manner such that load unbalance might be corrected prior to reaching a high operating frequency.

Referring also to FIG. 2, an exemplary sequence of alternating voltage 32 and resulting alternating current 33 that the inverter 17 might provide to the motor on line 24 can be observed. Because a motor is inductive by nature, the alternating current 33 usually lags the alternating voltage 32 by a phase angle $\Phi$. When a motor load is stable and is balanced, the phase angle $\Phi$ only varies slightly during operation. However, when the load is unbalanced, the phase angle $\Phi$ oscillates during motor rotation.

Figure 3:
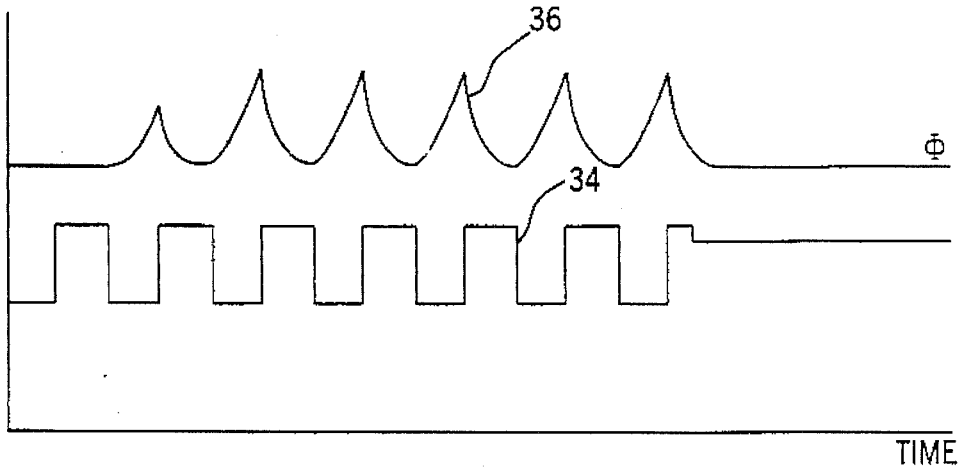
FIG. 3 is a graph illustrating an unbalanced load and the resulting variation in phase angle between the stator winding voltage and current.

Referring to FIG. 3, a signal indicating load imbalance 34 and a signal 36 resulting from the unbalanced load representing the magnitude of the phase angle $\Phi$ in the electrical cycle can be observed. Clearly the magnitude of the phase angle $\Phi$ can be used as an indicator of unbalanced load.

Figure 4:
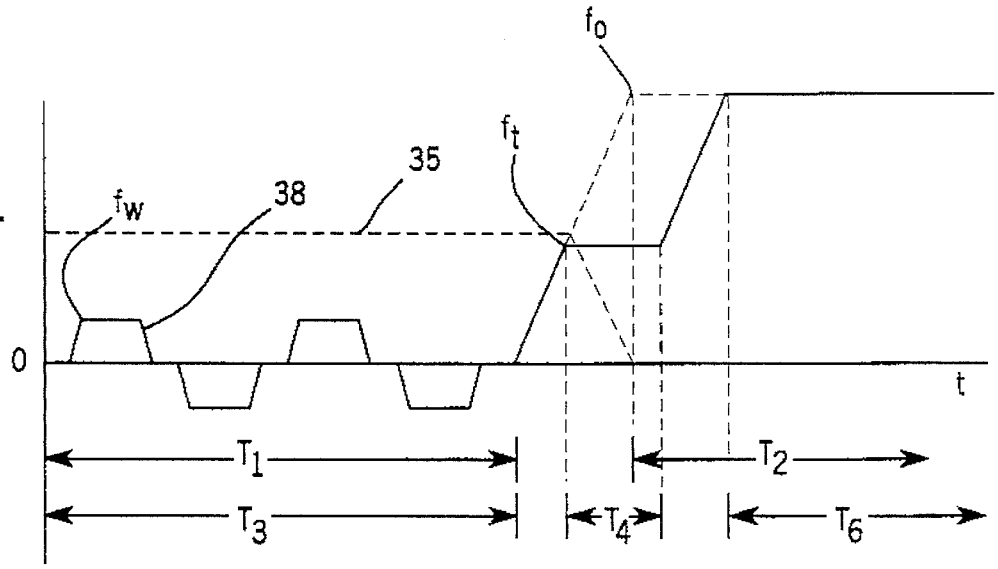
FIG. 4 is a graph illustrating various cycles that washing machine cycles through during operation.

In many motor applications, a motor is required to operate at various speeds and in both forward and reverse directions. For example, a washing machine typically operates in a number of distinct cycles. Referring to FIG. 4, an exemplary frequency curve 38 for a washing machine motor can be observed along with a water level curve 35. During a wash cycle $T_1$, a motor is typically driven at a low frequency $f_w$ in the forward and reverse directions, the direction of rotation being altered often during the wash cycle $T_1$ to jostle the load around within the washing basin.

After the wash cycle $T_1$, the motor is typically accelerated in the forward direction while the water level 35 in the washer is reduced. After reaching an operating frequency $f_0$, the motor is typically driven at the operating frequency $f_0$ during a spin cycle $T_2$ to use centrifugal force to ring out the load. Importantly, this type of cycling can result in serious damage to motor components if load unbalance is first detected at or near the operational frequency $f_0$ when the motor is rotating rapidly.

The control system 10 of the present invention detects load unbalance prior to reaching the operating frequency $f_0$. Referring to FIGS. 1 and 4, during a wash cycle $T_3$ the motor is driven at a low frequency $f_w$ in the forward and reverse direction. After the wash cycle $T_3$, the motor is accelerated in the forward direction up to a test frequency $f_t$ where the test frequency $f_t$ is much less than the operating frequency $f_0$. The motor is driven at the test frequency $f_t$ during a test cycle $T_4$.

Depending on fluctuations in the phase angle $\Phi$ between the alternating voltage 32 and alternating current 33 during the test cycle $T_4$, the controller 14 may increase the motor speed to the operational frequency $f_0$, thus entering an operating cycle $T_5$, may turn off the motor, or may force the motor to go through a second, but abbreviated, wash cycle after which the phase angle $\Phi$ can again be checked during a second test frequency cycle. Thus, the present invention eliminates the possibility of damaging motor components through unbalanced operation at a high operational frequency $f_0$.

After the motor is accelerated up to approximately the test frequency $f_t$, sensor 39 detects current and voltage on line 24. Bus 37 provides voltage and current signals to the voltage and current module 18 that have been stepped down appropriately for signal processing. It will become apparent that voltage and current information for all three supply lines 22, 23, 24 is not needed to determine unbalance as unbalance can be measured with information from only a single line.

Figure 2:
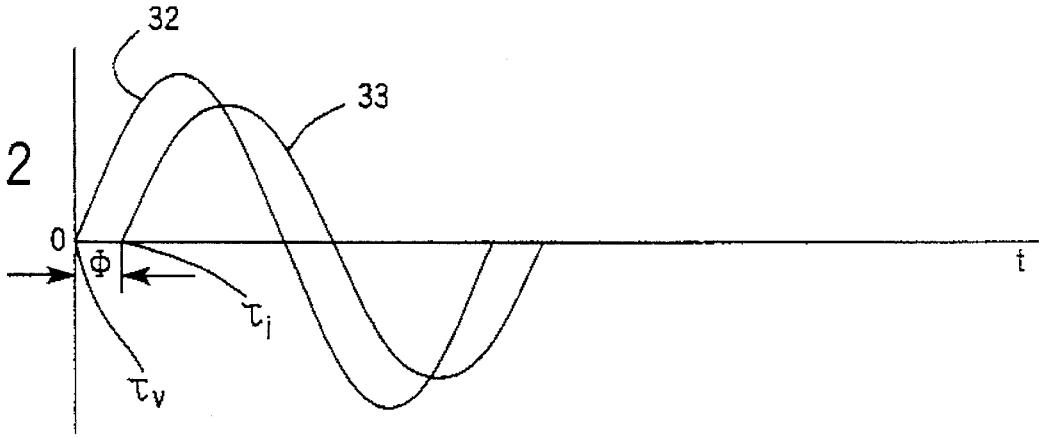
FIG. 2 is a graph illustrating an exemplary alternating voltage applied to a stator winding and a resulting and related alternating current.

Referring to FIGS. 1 and 2, the module 18 determines when the voltage 32 crosses zero and stores that time as voltage zero crossing time $\tau_v$. The module 18 also determines when the current 33 crosses zero and stores that time as current zero crossing time $\tau_i$. The voltage and current module 18 provides the voltage and current zero crossing times $\tau_v$ and $\tau_i$ to the controller 14 on bus 43. Importantly, the voltage and current module provides a continual stream of current and voltage zero crossing times $\tau_v$ and $\tau_i$ to the controller 14.

Figure 6:
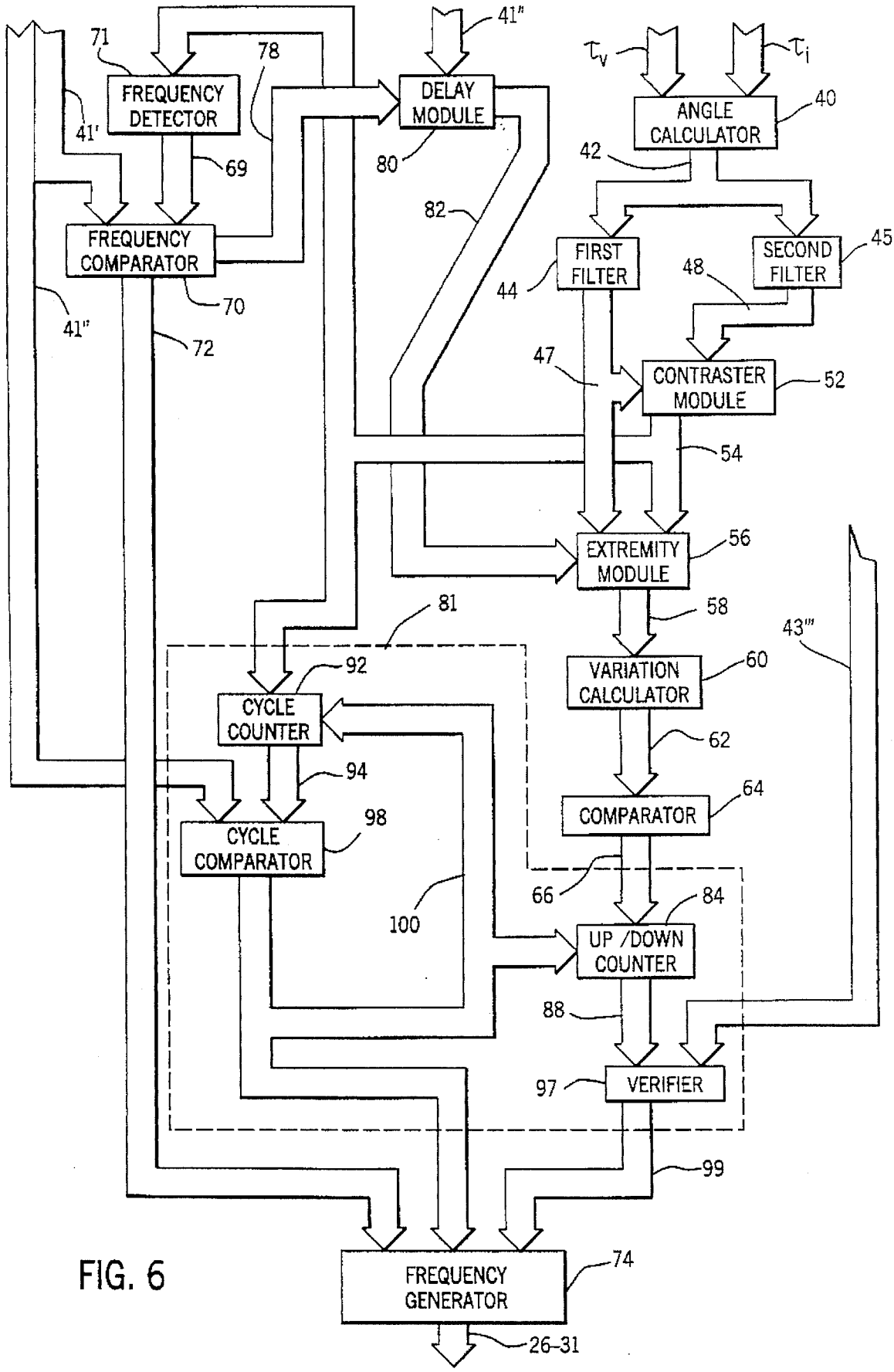
FIG. 6 is a flow chart depicting the operation of the controller which takes current and voltage zero crossing information, determines the degree of unbalance, and drives the motor accordingly.

Referring to FIGS. 1 and 6, the controller 14 consists of a number of different calculators, filters, and modules that operate together to determine the extent of unbalance. The current and voltage zero crossing times $\tau_v$ and $\tau_i$ for the electrical cycle are provided to an angle calculator 40. Referring also to FIG. 2, the angle calculator 40 subtracts the voltage crossing times $\tau_v$ from associated current crossing times $\tau_i$ and produces a plurality of phase angle signals $\Phi$.

The plurality of phase angle signals $\Phi$ form a phase angle spectrum 42. The angle spectrum 42 is provided to first and second low pass filters 44, 45. The first filter 44 filters out very high frequency components of the angle spectrum thus producing a lightly filtered first phase angle signal 47. The second filter 45 filters out medium and high range frequency harmonic components of the spectrum 42 producing a heavily filtered second phase angle signal 48.

Figure 5:
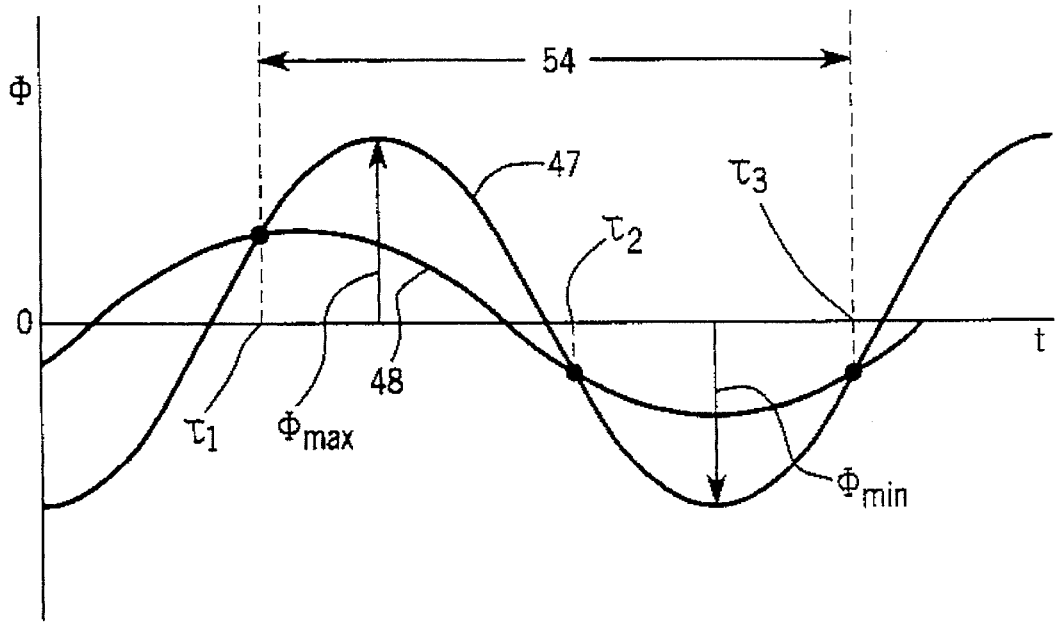
FIG. 5 is a graph illustrating heavily and lightly filtered phase angle signals.

Referring to FIG. 5, an exemplary first angle signal 47 and associated second angle signal 48 can be observed. As can be seen, the first angle signal 47, having been lightly filtered, will vary in amplitude more than the second angle signal 48, thus presenting a better representation of the actual fluctuations in phase angle $\Phi$.

Importantly, each phase angle signal $\Phi$ will correspond to one electrical cycle of the motor, and each electrical cycle is shorter than the motor's mechanical cycle. However, fluctuations in the magnitude of $\Phi$ given a specific unbalanced load, will be periodic and in phase with mechanical rotations of the motor. Thus, by comparing the first and second angle signals 47, 48 the period of a given mechanical rotation can be determined. For the purpose of this invention, it is not necessary to precisely ascertain the beginning and ending of the mechanical cycle period. The temporal boundaries of the mechanical cycle period are only needed as a time frame in which to determine high and low phase angle values for the first phase angle signal. Because the first angle signal 47 will not be near its high or low values when it crosses the second angle signal 48, only approximate times for the beginning and ending of a mechanical cycle are needed.

To determine the period of a given mechanical cycle, the first and second angle signals 47, 48 are provided to a contrastor module 52. The contrastor module determines when the first angle signal 47 is identical to the second angle signal 48 (i.e. when the two signals cross). Each three consecutive crossings of the two signals 47, 48 encompass a single mechanical motor rotation. Referring also to FIG. 5, a first crossing occurs at $\tau_1$, a second crossing at $\tau_2$, and a third crossing at $\tau_3$. Thus, a mechanical cycle takes place between $\tau_3$ and $\tau_1$. The two times $\tau_1$ and $\tau_3$ are provided to an extremity module 56 as a period signal 54 indicating the period of a mechanical cycle.

The period signal 54 is also provided to a frequency detector 71 that determines the frequency at which the controller is driving the motor. The frequency detector 71 counts the number of mechanical cycles over a period and produces an actual frequency signal 69 that is received by a frequency comparator 70.

The frequency comparator 70 compares the actual frequency signal 69 to a desired test frequency and produces two signals. A first signal, a correction signal 72, is provided to a frequency generator 74. The correction signal 72 indicates how the actual frequency 69 varies from the desired test frequency and is used by the frequency generator 74 to adjust the actual frequency 69 so that it is substantially identical to the test frequency. The frequency generator 74 controls the firing pulses on lines 26–31 and thus can easily change the actual motor speed.

It is important that the motor speed remains constant at the test frequency during the course of a test cycle. If the test frequency is allowed to vary, the effect of an unbalanced load will vary tending to indicate that the load is shifting during rotation.

A load that remains in a constant configuration during a test cycle, but is slightly unbalanced will have more mass to one symmetrical side of the rotational axis than to the other. At one frequency, a specific degree of unbalance would be detected. However, according to Eq. 1, if the angular velocity and frequency either increase or decrease while load balance is being tested, the centrifugal force associated with the load will increase or decrease by a squaring factor $\omega^2$. While the centrifugal force to both sides of the rotation axis will increase by the same factor, the force on the side with a greater mass will increase by a greater amount. Thus, the effect of a given unbalanced load changes as frequency changes.

On the other hand, as a washing basin spins, loose items often do not assume a constant configuration as frequency is altered. Thus, at one frequency one degree of unbalance may be detected while at another, referring to Eq. 1, the radius of a portion of a load might be different and therefore unbalance at that frequency might appear to be different.

Because of these concerns, a test frequency $f_t$ should be chosen that is high enough that the load items nearly all assume the position they would assume at the operational frequency $f_0$. While the inventors do not wish to be held to any specific relationship between test frequency and operational frequency, it is believed that where the operational frequency is approximately 180 Hz, the test frequency should be about 10% of the operation frequency, or approximately 10–18 Hz.

Once the test frequency $f_t$ has been reached, the frequency comparator 70 produces a second signal, an enable signal 78, which is provided to a delay module 80. The delay module 80 delays the enable signal 78 by a specified period, thus producing a delayed enable signal 82.

The enable signal 78 is delayed to allow the motor to operate at the test frequency for a short delay time while the load items shift and assume a steady state configuration and to allow the water within the washing basin to be emptied. By spinning the load at the test frequency during the delay period, centrifugal forces should draw some of the water out of the load.

After the delay time, the delayed enable signal 82 enables the extremity module 56 to begin calculating stability signals from which load balance can be ascertained. In addition to passing the first angle signal 47 to the contrastor module 52, the first filter 44 passes the first angle signal 47 to the extremity module 56. The extremity module 56 monitors a first angle signal 47 during the period specified by period signal 54 (i.e. $\tau_3$–$\tau_1$) and determines a maximum and a minimum magnitude $\Phi_{max}$, $\Phi_{min}$ of the first angle signal 47 during the period 54.

The maximum and minimum magnitudes $\Phi_{max}$, $\Phi_{min}$ are passed on as a magnitude signal 58 to a variation calculator 60. The variation calculator adds the absolute values of the maximum and minimum magnitudes $\Phi_{max}$, $\Phi_{min}$ and produces a stability signal 62 indicating the difference between the maximum and minimum magnitudes $\Phi_{max}$ and $\Phi_{min}$. The stability signal 62 is provided to comparator 64 which compares the stability signal 62 to a predetermined acceptable stability value. If the stability signal 62 is less than the acceptable stability value, the comparator produces an OFF trigger signal 66. However, if the stability signal 62 is greater than the acceptable stability value, the comparator produces an ON trigger signal 66.

While an ON trigger signal 66 indicates that a load is instantaneously unbalanced, it is possible that, in steady state, the load might be sufficiently balanced to operate safely at a higher frequency. For example, one portion of the load may periodically shift within the washing basin, being in a balanced position most of the time, but assuming an unbalanced position sporadically and only instantaneously. On the other hand, a load that is instantaneously balanced, may be unbalanced in steady state. Thus, it would be dangerous to rely on one stability signal to determine load stability (although, under certain circumstances, one stability signal might be sufficient).

In order to determine steady state load balance the trigger signal 66 is provided to a steady state module 81. The steady state module 81 tracks the number of ON and OFF trigger signals 66 during a number of mechanical cycles at the test frequency $f_t$ and determines if the load is sufficiently balanced in steady state.

The steady state module 81 includes a cycle counter 92 that receives the period signal 54 and counts mechanical cycles thus producing a cycle count signal 94. The cycle count signal 94 is received by a cycle comparator 98 and compared to a cycle maximum. The cycle comparator 98 produces a command signal 100 when the count signal 94 equals the cycle maximum.

While the cycle comparator 98 is comparing the count and cycle maximum, an up/down counter 84 receives the trigger signal 66. In operation, the up/down counter 84 counts up 1 for every mechanical cycle during which the load is unbalanced and counts down 1 for every mechanical cycle during which the load is unbalanced. The up/down count signal 88 is compared to the acceptable count signal by a verifier 97.

When the up/down count signal 88 becomes greater than the acceptable count signal, the verifier 97 produces an unbalanced signal 99. The unbalanced signal 99 indicates that the motor has been operating in an unbalanced state for a sufficient period of time during the test period that it would be dangerous to step the motor speed up to the operating frequency $f_0$. The verified signal 99 is provided to the frequency generator 74 which adjusts the motor speed appropriately.

Referring still to FIG. 6, if the cycle count signal 94 equals the cycle maximum prior to the up/down count signal equaling the acceptable count signal, the cycle comparator 98 produces an ON command signal which indicates that the load is sufficiently balanced and that it would be safe for the motor speed to be stepped up to the operating frequency $f_0$. When the command signal 100 is ON, the command signal is also provided to the cycle counter 92 and the up/down counter 84 and the up/down counter 84 is reset to zero, the cycle counter 92 is reset to zero, and the frequency generator 74 is directed to increase the frequency of the motor to the operating frequency $f_0$.

Importantly, once the controller 14 determines whether or not a load is balanced, the frequency generator 74 can alter the sequence with which it fires the switches 3–8 thus eliminating the possibility of the motor attaining the operating frequency $f_0$ when unbalanced.

The motor controller 14, and frequency generator 74 specifically, can be designed to do a number of different things when motor unbalance is detected. For example, the frequency generator could simply change the firing sequence of switches 3–8 in order to stop motor and load rotation. This would effectively stop the motor from rotating until a user could manually check the load and balance the load properly.

Alternatively, the frequency generator 74 might slow down and drive the motor through a second abbreviated wash cycle, jerking the load in forward and reverse directions such that the load would become more settled within the washing machine. If the second alternative is implemented after the second abbreviated wash cycle, the motor can be excited again up to the test frequency $f_t$ where, after a sufficient delay period, another phase angle spectrum can be derived and analyzed to detect whether or not the unbalance was corrected. If corrected, the motor velocity can be increased to the operating frequency. If uncorrected, either the motor could be driven through a third wash cycle or stopped until a user could manually rebalance the load.

Referring again to FIGS. 1 and 6, the human interface 12 can be used to input the desired test frequency $f_t$ at 41', a desired delay time 41" between the time at which the motor reaches the test frequency $f_t$ and the time when phase angle calculations begin, and the acceptable count signal 43'". In addition, the interface 12 can be used to input variables indicating how sensitive the controller should be to unbalance.

In operation, referring to FIG. 1, the controller 14, rectifier 16, and inverter 17 provide three phase alternating voltage and current on lines 22, 23, 24 to drive the motor 20 at various speeds. Referring also FIGS. 4 and 6, after a first wash cycle $T_3$, the controller 14 directs the inverter 17 to increase the motor speed to the test frequency $f_t$. A frequency comparator 70 determines whether or not an actual motor speed 69 is equal to a desired test frequency. If the actual 69 and desired test frequencies are not equal, the frequency comparator 70 indicates to the frequency generator 74 that the actual frequency 69 must be adjusted and the frequency generator 74 adjusts the actual frequency accordingly. Once the actual 69 and desired test frequencies are identical, the frequency comparator 70 produces an enable signal 78. The enable signal 78 is delayed by delay module 80 for a period while water is drained from the washing machine and the load settles into a steady state configuration.

After the delay, the delay module produces delayed enable signal 82. The delayed enable signal 82 enables an angle calculator 40 to determine a series of electrical cycle phase angle signals $\Phi$ between voltage and current zero crossings.

The series of signals form a phase angle spectrum 42 which is filtered by first and second filters 44, 45. Referring also to FIG. 5, the first filter 44 produces a lightly filtered first angle signal 47 and a second filter 45 produces a heavily filtered second angle signal 48.

The first and second angle signals 47, 48 are provided to a contrastor module 52 which uses the two signals 47, 48 to determine a mechanical cycle and produces a period signal 54. The period signal 54 and first angle signal 47 are received by an extremity module 56 which determines the maximum and minimum phase angle magnitudes of the first angle signal 47 during the mechanical cycle specified by the period signal 54 and produces a magnitude signal 58. A variation calculator 60 adds the maximum and minimum phase angle signals $\Phi_{max}$, $\Phi_{min}$ and produces a stability signal 62. The stability signal 62 is received by comparator 64 and compared to an acceptable stability signal and a trigger signal 66 is produced indicating whether or not the stability signal is greater than or less than the acceptable stability signal.

The steady state module 81 counts mechanical cycles and, tracks the trigger signal 66 to determine whether or not, in steady state during a specified number of mechanical cycles, there are too many trigger signals indicating an unbalanced load. If, after a certain number of mechanical cycles, the number of trigger signals indicating an unbalanced load has not surpassed an acceptable number, the steady state module 81 indicates to the frequency generator 74 that the frequency of the motor should be stepped up to the operating frequency $f_0$.

On the other hand, if a dangerously large number of trigger signals indicate that the load is unbalanced prior to a specified number of mechanical cycles, the steady state module 81 indicates to the frequency generator 74 that the motor should either be stopped or driven through some other type of cycle in an attempt to rebalance the load.

Although the present invention has been described above in the context of an apparatus, it should be understood that the present invention contemplates a method to be used with a motor controller for detecting unbalanced load, wherein the motor has at least one stator winding and operates in a mechanical cycle. The method comprises the steps of continuously determining a phase angle between a stator winding voltage and a stator winding current to produce a phase angle spectrum in the form of phase angle signal, determining a period of mechanical cycle of a motor, determining a difference between the maximum and the minimum of the phase angle signal during the mechanical cycle to produce a stability signal, comparing the stability signal to an acceptable stability value, and, if the stability signal is greater than the acceptable stability value, either producing an alarm signal or suspending motor operation until the load can be rebalanced by a user. Importantly, the method of the present invention is carried out at a test frequency which is relatively lower than the operational frequency of the motor.

As the method of the present invention is quite simple and most motor controllers include a central processing unit to control motor operation, the method of the present invention is particularly useful in that it can easily be implemented in software so that no additional hardware is required.

It should also be understood that the methods and apparatuses described above are only exemplary and do not limit the scope of the invention, and that various modifications could be made by those skilled in the art that may fall under the scope of the invention. For example, there are many different ways to count mechanical cycles of a motor, determine current voltage and zero crossing times, and determine motor speed, and any one of those ways could be used in the present invention. In addition, the human interface 12 could be used to input many different operating parameters. For example, a balance range may be adjusted using the human interface 12 that generally indicates the critical line between balance and imbalance. The controller 14 could use the balance range to determine acceptable count values and an acceptable stability signal value for use by the comparator 64. On the other hand, all of the motor parameter variables used by the controller 14 could be programmed directly into the controller 14 thus eliminating the need for a human interface.

Furthermore, two test frequencies may be employed with the present invention to determine unbalance twice to add a level of redundancy to the system. For example, the method described above may be used at a first test frequency and, if the load appears to be balanced, the frequency generator 74 may step up the motor speed to a second test frequency that is still less than the operating frequency and perform the method again at that frequency. If the load still appears to be balanced, the frequency generator 74 may then at that time step up the motor speed to the operating frequency. If, however, the load appears to be unbalanced at the second test frequency, the frequency generator 74 can then operate appropriately.

In addition, the method and apparatus may be used with a motor having a relatively low operating frequency. In this case, the test frequency might be the operating frequency and a simplified machine might simply turn off the motor when imbalance is detected.

In order to apprise the public of various embodiments that may fall within the scope of the invention, the following claims are made:

We claim:

1. A method to be used with a motor controller for detecting a mechanically unbalanced load, the motor operating at a number of different frequencies including various operating frequencies wherein the operating frequencies are relatively high frequencies, the method comprising the steps of:

(a) prior to increasing the motor speed to any high operating frequency, increasing the motor speed to a test frequency that is substantially less than the operating frequency;

(b) maintaining the motor speed substantially equal to the test frequency during a test period;

(c) determining whether or not the motor load is mechanically balanced or unbalanced during the test period including the steps of;

(i) continuously determining a phase angle between a stator winding voltage and a stator winding current to produce a phase angle spectrum in the form of a phase angle signal:

(ii) determining a period of a mechanical cycle of the motor:

(iii) determining a difference between the maximum and minimum of the phase angle signal during the mechanical cycle to produce a stability signal: and (iv) comparing the stability signal to an acceptable stability value:

(v) if the stability signal is greater than the acceptable stability value, producing a signal indicating that the load is unbalanced;

(d) if the stability signal is less than the acceptable stability value, stepping the motor speed up to the operating frequency; and (e) if the stability signal is greater than the acceptable stability value, producing an alarm signal indicating that the load is unbalanced.

2. The method as recited in claim 1 wherein the step of determining a period of the mechanical cycle includes the steps of:

(a) generating a first phase signal which is the equivalent of the phase angle signal after light filtering;

(b) producing a second phase signal which is the equivalent of the phase angle signal after heavy filtering; and (c) comparing the first and second phase signals to determine the period of a mechanical cycle, the period between each three consecutive crossings of the first and second phase signals being the period of a mechanical cycle.

3. The method as recited in claim 1 further including the step of, after the frequency of the motor has reached the test frequency, delaying the step of determining the phase angle for a delay time.

4. The method as recited in claim 1 wherein the method further includes the steps of, if the load is balanced, increasing the frequency of the motor to the operating frequency.

5. The method as recited in claim 1 further including the step of, if the load is unbalanced, stopping motor rotation.

6. The method as recited in claim 5 further including the step of, if the motor is stopped, after a suspension period, exciting the motor to again rotate at the test frequency and again detecting the degree of load unbalance.

7. The method as recited in claim 1 further including the steps of, if the load is unbalanced:

(a) driving the motor in a wash cycle where the frequency of rotation is less than the test frequency, during the wash cycle the motor being rotated in one direct for a short period and then in the other direction for a short period, the rotation direction alternating often during the wash cycle; and (b) after the wash cycle, increasing the motor speed again to the test frequency and again detecting the degree of load unbalance.

8. The method as recited in claim 1 wherein the controller includes a human interface and the method further includes the step of, prior to increasing the motor speed to the test frequency, inputting the acceptable stability value, the delay time, and the test frequency.

9. The method as recited in claim 1 wherein the step of determining the phase angle includes the steps of:

(a) determining a voltage time indicating the time at which the stator voltage crosses zero;

(b) determining a current time indicating the time directly following the voltage time at which the stator current crosses zero;

(c) subtracting the voltage time from the current time to produce an angle time;

(d) multiplying the angle time by the test frequency to produce a rotation signal; and (e) multiplying the rotation signal by 360 to produce the phase angle signal.

10. The method as recited in claim 1 wherein the controller produces a first count signal and a second count signal, the first and second count signals originally being set to zero, the method further including the steps of, prior to producing the alarm signal:

(a) increasing the first count signal for each mechanical cycle during which the stability signal is greater than the acceptable stability signal and decreasing the first count signal for each mechanical cycle during which the stability signal is less than the acceptable stability signal;

(b) increasing the second count signal each time the motor rotates through a mechanical cycle;

(c) comparing the second count signal to a maximum count signal;

(d) when the second count signal equals the maximum count signal, setting both the first and second count signals equal to zero;

(e) when the second count signal equals the maximum count signal, increasing the motor speed to the operating frequency;

(e) comparing the first count signal with an acceptable count value; and (f) if the first count signal is greater than the acceptable count value, producing the alarm signal.

11. The method as recited in claim 4 further including the steps of, prior to increasing the frequency of the motor to the operating frequency, increasing the frequency of the motor to a second test frequency that is less than the operating frequency but greater than the test frequency and again detecting the degree of load unbalance.

12. A method to be used with a motor controller for detecting a mechanically unbalanced load, the motor having at least one stator winding and operating in a mechanical cycle, the method comprising the steps of:

(a) continuously determining a phase angle between a stator winding voltage and a stator winding current to produce a phase angle signal;

(b) generating a first phase angle signal which is the equivalent of the phase angle signal after light filtering;

(c) producing a second phase signal which is the equivalent of the phase angle signal after heavy filtering;

(d) comparing the first and second phase signals to determine the period of a mechanical cycle, the period between each three consecutive crossings of the first and second phase signals being the period of a mechanical cycle;

(e) determining the difference between the maximum and minimum values of the first phase signal during a mechanical cycle to produce a stability signal;

(f) comparing the stability signal to an acceptable stability value; and (g) if the stability signal is greater than the acceptable stability value, producing an alarm signal.

13. The method as recited in claim 12 wherein the motor normally operates at an operating frequency and the method is carried out at a relatively lower test frequency, and the method further includes the steps of, prior to determining the phase angle:

(a) increasing the motor speed to the test frequency;

(c) maintaining the motor speed substantially equal to the test frequency during a test period wherein the test period includes a delay time;

(d) after the delay time, maintaining the motor speed substantially equal to the test frequency until the stability signal has been compared to the acceptable stability value;

(e) if the stability signal is less than the acceptable stability value, increasing the frequency of the motor to the operating frequency; and (f) if the stability signal is greater than the acceptable stability value, stopping motor rotation.

14. The method as recited in claim 13 further including the step of, if the motor is stopped, after a suspension period, rotating the motor again at the test frequency and then comparing the first and second phase signals again.

15. A method to be used with a motor controller for detecting unbalanced load, the motor having at least one stator winding and being driven at various frequencies including relatively high operational frequencies, the method comprising the steps of:

(a) increasing the motor speed to a test frequency that is substantially less than the operational frequency;

(b) determining a plurality of phase angles between a stator winding voltage and a stator winding current, the plurality of phase angles together forming a phase angle spectrum;

(c) filtering the phase angle spectrum to produce a first phase signal;

(d) filtering the phase angle spectrum to produce a second phase signal which is filtered to a greater degree than the first phase signal;

(e) comparing the first and second phase signals to determining the a mechanical cycle of the motor, the period between each three consecutive crossings of the first and second phase signals being a mechanical cycle;

(f) determining the difference between the maximum and minimum values of the first phase signal during said mechanical cycle to produce a stability signal;

(g) comparing the stability signal to a permissible value;

(h) increasing a count signal when the stability signal is greater than the permissible value and decreasing the count signal when the stability signal is less than the permissible value;

(i) comparing the count signal with an acceptable count value;

(j) if the count signal is greater than the acceptable count value, producing an alarm signal;

(k) repeating steps a–j during a test period; and (l) if no alarm signal is produced, after the test period, increasing the motor speed to the operating frequency.

16. An apparatus to be used with a motor controller for detecting a mechanically unbalanced load, the motor having at least one stator winding, the motor operating at a number of different frequencies, various operational frequencies being relatively high frequencies, the apparatus including:

(a) a frequency generator that, prior to increasing the motor speed to an operational frequency, increases the motor speed to a test frequency that is substantially less than the operational frequency and maintains the motor speed substantially equal to the test frequency during a test period;

(b) a balance detector to determine, during the test period, whether or not the motor load is mechanically balanced or mechanically unbalanced;

(c) if the load is mechanically balanced, stepping the motor speed up to the operating frequency; and (d) if the load is mechanically unbalanced, producing an alarm signal.

17. The apparatus as recited in claim 16 wherein the balance detector includes:

(a) an angle calculator to determine a phase angle between a stator winding voltage and a stator winding current to produce a phase angle signal;

(b) a difference calculator to determine the difference between the maximum and minimum of the phase angle signal during a mechanical cycle to produce a stability signal;

(c) a comparator to compare the stability signal to an acceptable stability value to produce a trigger signal; and (d) an alarm for producing an alarm signal when the trigger signal indicates that the stability signal is greater than the acceptable stability value.

18. The apparatus as recited in claim 17 wherein the difference calculator includes:

(a) a first filter that receives the phase angle signal and filters the phase angle signal to produce a first phase angle signal;

(b) a second filter that receives the phase angle signal and filters the phase angle signal to a greater degree than does the first filter to produce a second phase angle signal;

(c) a contrastor to compare the first and second phase signals to determine the period of a mechanical cycle, the period between each three consecutive crossings of the first and second phase angle signals being the period of the mechanical cycle;

(d) an extremity module that records the maximum and minimum values of the first phase angle signal during the mechanical cycle; and (e) a variation calculator to determine the difference between the maximum and minimum values of the first phase signal during a mechanical cycle to produce the stability signal.

19. The apparatus as recited in claim 18 further including a delay module that, after the motor speed is substantially similar to the test frequency, delays the comparison between the stability signal and the acceptable stability value for a delay period.

20. The apparatus as recited in claim 19 wherein, if the stability signal is less than the acceptable stability value, the frequency generator increases the frequency of the motor to the operating frequency.

21. The apparatus as recited in claim 16 further including an interrupter to stop motor rotation if the load is unstable.

22. The apparatus as recited in claim 21 further including a restarter that, if the motor is stopped by the interrupter, excites the motor after a suspension period to again rotate at the test frequency.

23. The apparatus as recited in claim 16 including a human interface to input the acceptable stability value, the delay time, and the test frequency prior to increasing the motor speed to the test frequency.

24. The apparatus as recited in claim 17 further including:

(a) a counter to produce a count signal that is originally set to zero and is increased each time the trigger signal indicates that the stability signal is greater than the acceptable stability signal and is decreased each time the trigger signal indicates that the stability signal is less than the acceptable stability signal; and (b) a verifier to compare the count signal with an acceptable count value to produce the alarm signal if the count signal is greater than the acceptable count value.

* * * * *